US007757769B2

(12) United States Patent
Hill et al.

(10) Patent No.: US 7,757,769 B2
(45) Date of Patent: Jul. 20, 2010

(54) WELLBORE AND RESERVOIR TREATMENT DEVICE AND METHOD

(75) Inventors: Freeman L. Hill, Houston, TX (US); Gary J. Cresswell, Spring, TX (US); Joseph Gregory Barolak, Spring, TX (US); Randy L. Evans, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 144 days.

(21) Appl. No.: 11/867,502

(22) Filed: Oct. 4, 2007

(65) Prior Publication Data

US 2009/0090507 A1 Apr. 9, 2009

(51) Int. Cl.
*E21B 43/26* (2006.01)
*E21B 49/10* (2006.01)

(52) U.S. Cl. ..... 166/305.1; 166/100

(58) Field of Classification Search ..... 166/305.1, 166/100, 101, 169, 223
See application file for complete search history.

(56) References Cited

U.S. PATENT DOCUMENTS

| | | | | |
|---|---|---|---|---|
| 2,258,614 | A * | 10/1941 | Kendrick | 166/371 |
| 3,346,049 | A * | 10/1967 | Brown | 166/286 |
| 6,782,948 | B2 | 8/2004 | Echols et al. | |
| 7,128,151 | B2 | 10/2006 | Corbett | |
| 7,198,105 | B2 * | 4/2007 | Grant et al. | 166/305.1 |

* cited by examiner

*Primary Examiner*—David J Bagnell
*Assistant Examiner*—Catherine Loikith
(74) *Attorney, Agent, or Firm*—Bracewell & Giuliani LLP

(57) ABSTRACT

A modular wellbore treatment system having a reservoir for holding wellbore/reservoir treatment material, a pump for pressurizing and delivering the wellbore/reservoir treatment fluid, and a sealing section for creating a localized pressurized zone proximate to a region of a formation to be treated. The wellbore treatment fluid includes permeability modifiers, gel, acids, stimulation fluids, epoxy type substances, void fillers, gravel pack fixing compounds, brine, reactive fluids to water, oil, and gas, and alcohol.

17 Claims, 2 Drawing Sheets

WELLBORE AND RESERVOIR TREATMENT DEVICE AND METHOD

BACKGROUND

1. Field of Invention

The invention relates generally to the field of oil and gas production. More specifically, the present invention relates to a device used in treating a wellbore and reservoir. Yet more specifically, the present invention relates to a self-contained device disposable in a wellbore for treating components of the production flow path.

2. Description of Prior Art

Hydrocarbon producing subterranean formations may be treated in any number of ways. One way comprises gravel packing, which is typically used for unconsolidated reservoirs for sand control and may be used in open hole as well as cased hole environments. Gravel pack typically involves injecting a fine particulate matter such as sand or engineered proppants, also referred to as gravel, within the formation surrounding a hydrocarbon producing wellbore. Injecting this gravel into the formation under pressure provides a gravel pack, or a packed sand layer in the region of the formation surrounding the wellbore. The gravel pack prevents connate sand from making its way from the formation and into the wellbore. Isolating the sand from the production flow path in the wellbore enhances hydrocarbon production by not allowing contaminant matter into the wellbore that may hinder fluid production or destroy production hardware components.

After inserting the gravel into the formation, means for retaining the gravel in the formation may be employed, such as a screen or a slotted sleeve to maintain this material in the formation. Other modes of wellbore enhancements include treatment materials, such as stimulation fluids and/or acidizing fluids. These may be injected under pressure for promoting hydrocarbon production in a particular zone in the formation. Certain gels may also be inserted as needed; when excess water is being produced by a well, fluids for manipulating the permeability of the production flowpath may be inserted as well.

Generally these well treatment fluids are provided to the zone of treatment via a tubular member that extends from the reservoir region back to the surface. To overcome the pressure losses of the long tubing length and downhole hydrostatic pressure, a pumping system is typically employed at the surface. These pumping systems may be disposed within a service truck or self contained adjacent the opening of the wellbore. A substantial amount of fluid, in excess of what is actually injected into the treatment area, remains in the tubing string disposed in the wellbore. Accordingly, these surface treatment systems have inherent inefficiencies not only due to the excess fluid, but also due to the large power requirements used in pressurizing this treatment fluid. Also, placement is not always accurate or confined to a specific area leading to large segments being treated unnecessarily.

SUMMARY OF INVENTION

The present disclosure concerns a wellbore treatment system comprising a reservoir for a wellbore treatment substance, a pump for motivating the substance from the reservoir and into an adjoining formation, and a sealing section. The treatment system is a self contained unit disposable within a wellbore on wireline, slickline, tubing, coiled tubing, as well as pipe. Accordingly, usage of the treatment system may be affected without the need for supplying treatment substances from the wellbore surface. The treatment substance, may comprise a well treatment fluid, cement (for bonding wellbore casing to formation), cementing agents, void fillers, proppant, gel, stimulation fluids, acidizing agents, brine and alcohol. The sealing section may comprise an extendable pad with a sealed outer parameter and fluid conduits on the inner circumference of the pad for delivering fluid on the inner portion sealed by the outer circumference and into the surrounding formation. Perforations through the wellbore inner surface, casing, and adjoining cement may provide a conduit allowing the treating fluid to make its way into the formation from the device. In another optional embodiment, a sealing section may comprise an inflatable packer with tubes radially disposed outward from the packer thereby providing fluid communication from within the packer into the formation, annular cement sheath, or gravel pack. The packer embodiment also will have a sealing surface on its upper and lower outer radial surfaces.

BRIEF DESCRIPTION OF DRAWINGS

Some of the features and benefits of the present invention having been stated, others will become apparent as the description proceeds when taken in conjunction with the accompanying drawings, in which.

Figure 2:
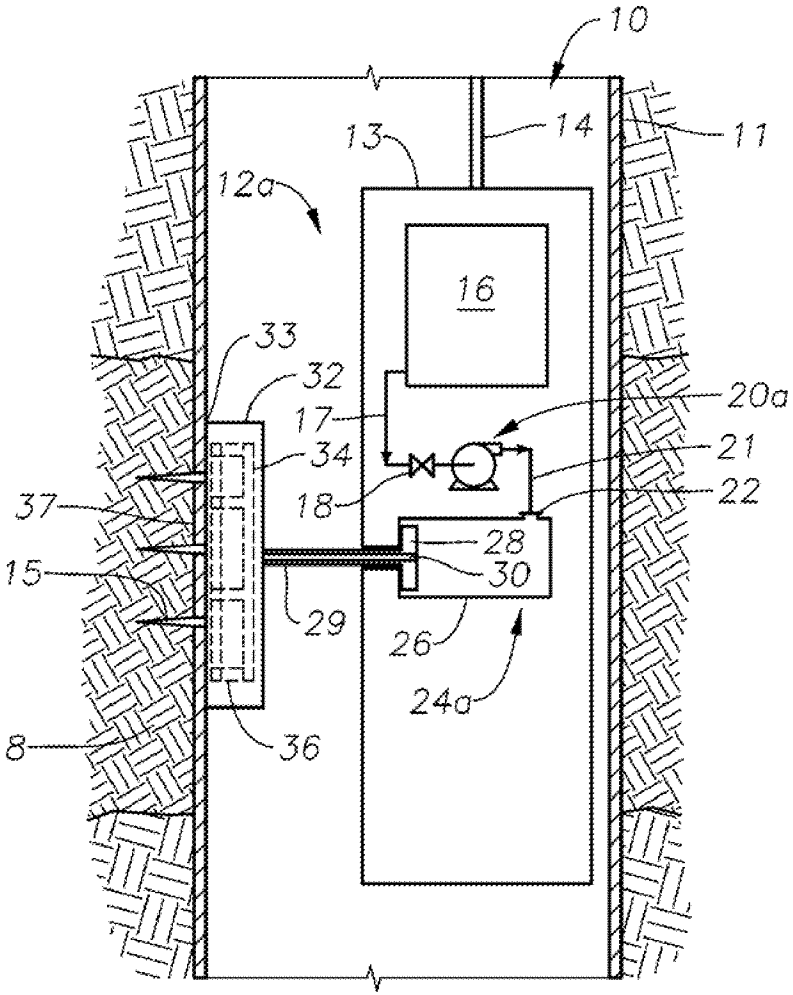
FIG. 2 illustrates a partial cutaway side view of a treatment system having an extendable pad.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

The present disclosure concerns a wellbore treatment system that is a self contained and fully disposable within a wellbore. The disposal means may comprise wireline, slickline, tubing, or any other manner of conveying a wellbore treatment system downhole. Self contained means the system includes therein a wellbore treatment substance, a means for urging the treatment substance out into an adjacent formation, and a localized sealing means to isolate application of the treatment substance.

Figure 1:
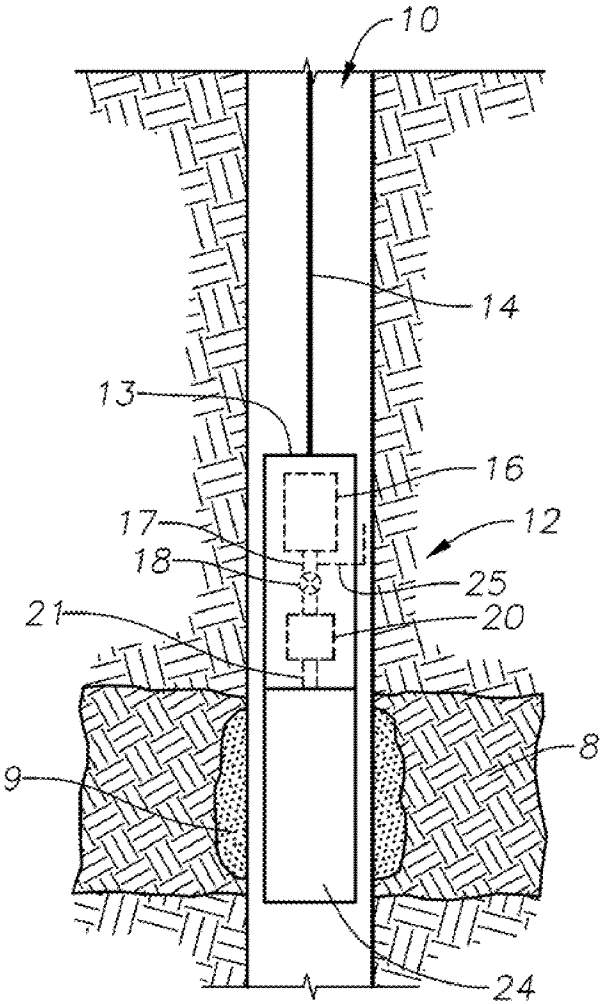
FIG. 1 is partial cutaway side view of a treatment system in a wellbore.

With reference now to FIG. 1 a partial cutaway view of a treatment system 12 is shown disposed within a wellbore 10. In this embodiment, the treatment system 12 is disposed on wireline 14, however, as noted above any downhole conveyance means can be employed for lowering and raising the treatment system within the wellbore. The treatment system 12 is configured for disposal within the wellbore and includes a reservoir section 16, a pressurizing member 20 and a sealing section 24. Although the wellbore 10 is shown as open hole, the treatment means is not restricted to use in an open hole but can also be used in a cased hole situation. As shown, the sealing means 24 is proximate to a formation 8 that circumscribes the wellbore 10. In operation, the reservoir 16 contains a treatment substance for injecting into a portion of the surrounding formation 8 or the near wellbore area. The pressurizing member 20 pressurizes the treatment substance so it may be injected into the formation 8. Examples of suitable pressurizing member 20 include pumps, such as centrifugal, positive displacement pumps, and reciprocating pumps. Optionally, the pressurizing means may comprise a compressed fluid wherein its expansion imparts a pressurizing force onto the treatment substance. In another alternative embodiment, the reservoir section 16 may be pressurized prior to being inserted in the wellbore. In FIG. 1, the region 9 of the formation 8 to be treated is shown adjacent the wellbore 10 where the sealing section 24 is located.

The injection means of the embodiment shown in FIG. 1 comprises the pressurizing means 20 in communication with the reservoir via a line 17. The line 17 includes a selectively open or closed valve 18 for allowing or blocking flow of a treatment substance through the line 17. Another line 21 is disposed between the exit of the pressurizing member 20 and the inlet of the sealing section 24. The line 21 provides flow communication between the exit of the pressurizing means 20 and the sealing section 24. The treatment substances discussed herein for use with the present device include gravel pack fixing material/fluids, acidizing fluids; brine; alcohol; wellbore stimulation fluids; material for filling voids in casing cement or gravel packs, permeability modifiers, fluids that react with water, oil, or gas, and combinations thereof. Optionally, wellbore fluid could be mixed with the treatment substances. A wellbore fluid line 25 is shown extending from the line 17 to the wellbore fluid.

Another embodiment of a treatment system 12*a* is provided in a side cutaway view in FIG. 2. In this embodiment, the treatment system 12*a* is disposed within a wellbore 10 on a wireline 14. The treatment system 12*a* comprises a housing 13, and disposed inside the housing 13, a reservoir 16, a pump 20*a* and a sealing section 24*a*. In this embodiment, the sealing section 24*a* comprises a cylinder 26, a piston 28 connected to a rod 29, and a pad 32 disposed on the terminal end of the rod 29. Another deployment of a pad device could be through an arm aperture type device.

Shown in a side cutaway view, the cylinder 26 is a largely cylindrical enclosure formed to coaxially receive the piston 28 therein. The piston 28 is a disk like structure formed for coaxial travel along the inside length of the cylinder 26. In the embodiment shown, the pad 32 in an extended position away from the housing 13 and urged against the inner circumference of the casing 11. A manifold 34 shown in dashed outline is provided within the body of the pad 32. As will be described in detail below, the manifold 34 includes leads 36 for receiving the treatment substance from the line 34 and for delivering a treatment substance to the formation 8.

In one mode of operation of the treatment system 12*a* of FIG. 2, wellbore treatment from the reservoir 16 flows to the pump 20*a* through the line 17 and open valve 18. The discharge of the pump 20*a*, connected via line to the cylinder 26, enters the cylinder 26 through an inlet 22. Delivering the pressurized fluid into the cylinder in turn urges the piston 28 toward the end of the cylinder 26 proximate to the pad 32 thereby urging the pad 32 toward the inner surface of the casing 11. The pump discharge pressure should provide sufficient force onto the piston 28 so when the piston 28 pushes the pad 32 against the casing 11 a sealing surface 33 forms on the outer circumference of the pad.

Wellbore treatment material is injected into the formation 8 through the pad 32. The pressurized material flows from the cylinder 26 into a conduit 30 and through the rod 29. From the rod 29, the material passes into the manifold 34 where it is directed to the leads 36. The material, as noted above, is pumped to the cylinder via the pump 20*a* from the reservoir 16. Continued operation of the pump 20*a* thus not only urges the pad 32 into a sealing engagement with the casing but also forces the material into the leads 36 where it can then be passed into the region 37 (shown in a dashed outline) between the pad 32 and the casing 11. Forming the sealing surface 33 prevents the material from flowing past the pad 32 perimeter, continued operation of the pump 20*a* pumps additional material into the region 37 thereby increasing its pressure. When the pressure in the region 37 begins to exceed the pressure in the formation 8, the wellbore treatment material can then flow into the formation 8 via the perforations 15. Thus, by use of the treatment system 12*a* of FIG. 2, all methods of treatment of the formation 8 may be accomplished with this device.

Figure 3:
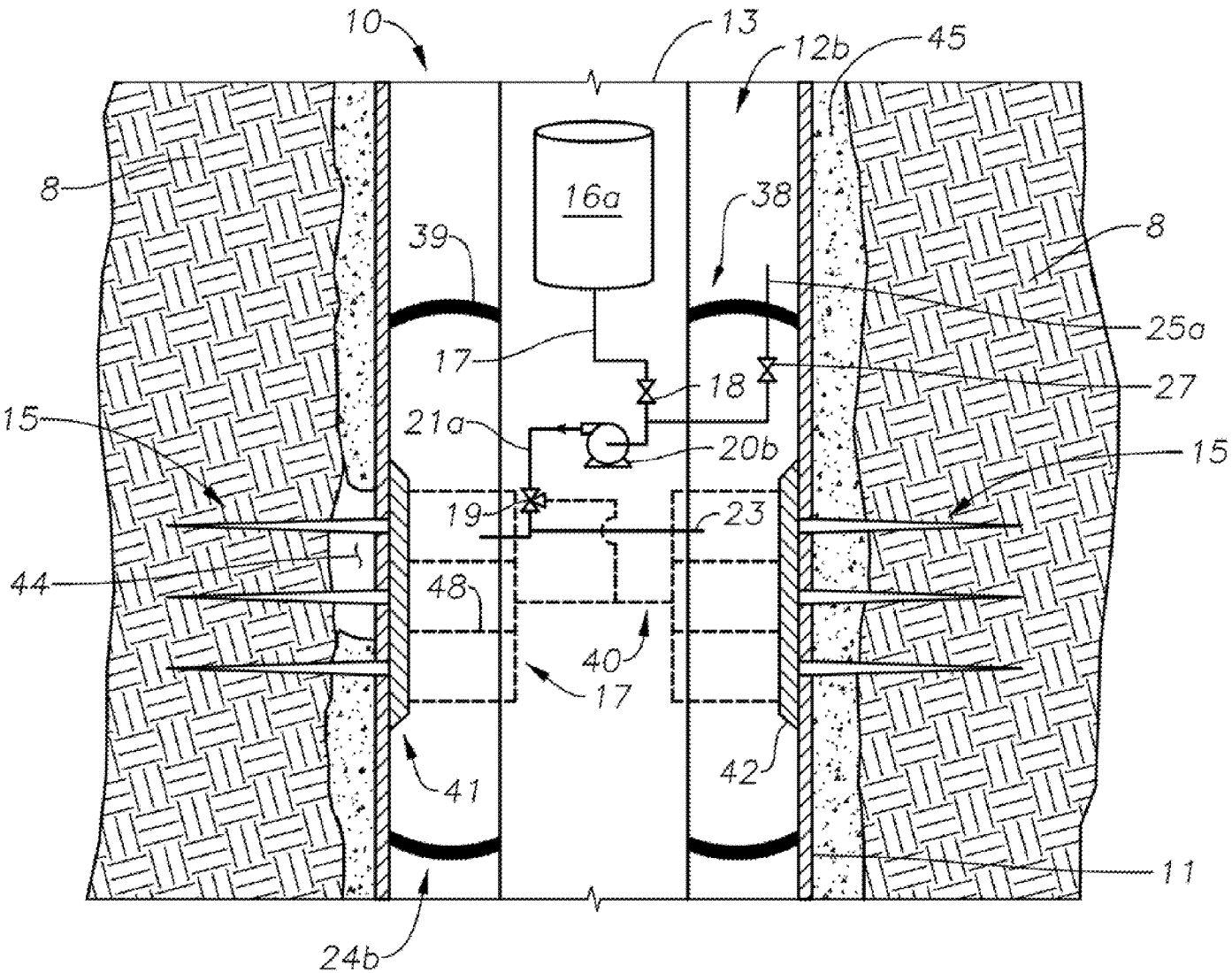
FIG. 3 provides in side partial cutaway view an embodiment of a treatment system employing an expandable member.

FIG. 3 provides a side cross sectional view of an alternative treatment system 12*b* disposed in a wellbore 10. In this embodiment, the treatment system 12*b* comprises a housing 13 having disposed therein a reservoir 16*a*, a pump 20*b* and a sealing section 24*b*. In the embodiment of FIG. 3, the sealing section 24*b* is an expandable member, such as an inflatable packer 38. As with the pad 32, the packer 38 includes an outer sealing surface 39 thereby providing a seal around the region 41 (shown in dashed outline) defined by the outer radial area of the packer and the corresponding inner circumference of the casing 11. The treatment system 12*b* is disposed within the wellbore 10 such that the outer sealing surface 39 is adjacent a region in the formation 8 wherein treatment material is desired to be injected into formation 8. Perforations 15 are provided enabling communication between the wellbore 10 and within the formation 8.

In one mode of operation, the treatment system 12*b* is lowered into the wellbore at the desired depth, the pump 20*b* is initiated to pressurize fluid from the reservoir 16*a* and deliver it to the inside of the member via the discharge line 21*a*. The pressurized fluid will exit the discharge line 21*a* through ports 23 on the terminal end of the line 21*a*. Delivering the pressurized fluid into the packer inflates the expandable member (inflatable packer 38) until the member fully encompasses the annular area between the housing 13 and the inner circumference of the casing 11. It should be pointed out however, that all embodiments of the treatment system can be used either in an open hole environment or a cased hole. Continued inflation of the expandable member provides the sealing surface 39 on the upper and lower ends of the inflatable packer 38 thereby forming the sealed off region 41 between the packer outer radial surface and the casing inner surface. Optionally, wellbore fluid may be used to inflate the packer.

Upon creating the sealed off region 41 through packer inflation, the treatment fluid can then be delivered into the formation 8. A three-way valve 19 is shown in the line 21*a* configured to direct flow either for inflating the packer or injecting treatment fluid. Wellbore fluid may be mixed with the treatment fluid via the wellbore fluid line 25*a* or can be delivered by itself to the formation 8 or used to inflate the packer. A remotely operated valve 27 is provided in the fluid line 25*a* for selectively drawing in wellbore fluid. Treatment fluid flow is diverted from the exit line 21*a* into the line 40. Line 40 splits and feeds headers 47. The headers 47 branch off into tubes 48 that are in communication with the region 41. With its sealed off outer periphery, the region 41 will experience a pressure increase with continued flow of pressurized treatment material. When the pressure in the region 41 exceeds the pressure within the formation 8 the treatment material will be urged into the formation 8 from the region through the perforations 15. Thus diverting treatment fluid flow into the line 40, headers 47, and tubes 48 provides pressurized treatment fluid into the area where it is needed. Accordingly, one of the advantages of the present system is that all elements are included within a device disposed in a wellbore. Thus the need for surface pumping trucks, and tubing from the surface equipment to the downhole device is unnecessary.

An optional screen 42 may be provided on the outer circumference of the inflatable packer 38. A cement layer 45 is shown in this embodiment adhering the casing 11 within the formation 8. In some instances a void 44 may be present within the cement layer thereby leaving an uncemented region. Thus in one mode of use of the present device, an appropriate material, such as cement material or epoxy like materials, may be injected into the void 44 via a perforation 15.

The pump, may be powered either electrically, wherein the electrical source optionally may be a battery disposed with the downhole device, or may be provided via the conveyance means, i.e., wireline, slickline, tubing, or tractoring. Optionally, pressurized cells may be used for powering the pump. In one optional embodiment, the present device may be coupled with other tools for disposal within a wellbore wherein multiple operations may be performed with a single trip downhole. For example, a perforating gun may be attached either to the upper or lower portion wherein a perforating could tale place prior to injecting the treatment fluids into the formation.

In one mode of treatment the treatment fluid could be used in response to water production from particular perforations. Thus, a treatment fluid for reducing permeability to water or any fluid movement depending on the circumstances.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A wellbore treatment system disposable in a wellbore circumscribed by a subterranean formation, the system comprising:

a housing;

a reservoir in the housing;

treatment substance disposed within the reservoir;

a pad selectively extendable from the housing and into contact with a wall of the wellbore;

a manifold in the having an exit formed in a region between the pad and the wall of the wellbore; and a pressurizing source having an inlet in fluid communication with the reservoir and having an exit in fluid communication with an inlet to the manifold, so that when the pad is disposed over a perforation in the wall of the wellbore and the pressurizing source pressurizes treatment substance and discharges the pressurizing substance into the inlet to the manifold, the pressurized treatment substance enters the manifold and then the formation through the perforation.

2. The wellbore treatment system of claim 1, wherein the treatment substance is selected from the list consisting of gravel pack repair material, acidizing fluids, brine, alcohol, wellbore stimulation fluids, material for filling voids in casing cement or gravel packs, permeability modifiers, fluids that react with water, oil or gas, and combinations thereof.

3. The wellbore treatment system of claim 1, wherein the pressurizing source is in fluid communication with wellbore fluid.

4. The wellbore treatment system of claim 1, wherein the pressurizing source is selected from the list consisting of a centrifugal pump, a positive displacement pump, a reciprocating pump, a pressurized reservoir or a pre-pressurized fluid, and a pressurized fluid in fluid communication with the reservoir.

5. The wellbore treatment system of claim 1, further comprising a seal disposable on the wellbore wall.

6. The wellbore treatment system of claim 5, wherein the seal creates a region on the wellbore wall in pressure communication with the pressurizing source discharge.

7. The wellbore treatment system of claim 1, further comprising a sealing surface on the pad face circumscribing a sealed off region therein, wherein the sealed off region is in pressure communication with the pressurizing source discharge.

8. The wellbore treatment system of claim 7, wherein the pressurizing source discharge terminates in the sealed off region.

9. A downhole tool disposed in a wellbore formed through a subterranean formation, the tool comprising:

a reservoir;

formation treatment material disposed in the reservoir;

a pump having an inlet and a discharge;

a line connected between the reservoir and the pump inlet;

a discharge line connected on one end to the pump; and a seal member in selective sealing engagement with a wall of the wellbore so that when the seal member sealingly contacts the wellbore wall, a pressurized region is defined in a space circumscribed by the seal member and adjacent the wellbore wall that is pressure isolated from the pressure of the wellbore and in fluid communication with an end of the discharge line opposite the pump.

10. The downhole tool of claim 9, wherein the pressurized region is in fluid communication with the formation.

11. The downhole tool of claim 9, wherein the seal member comprises a pad extendable from the downhole tool.

12. The downhole tool of claim 11, wherein the discharge line extends through the pad.

13. The downhole tool of claim 9, further comprising a wellbore fluid intake line in fluid communication on one end with wellbore fluid and on its other end with the pump intake.

14. A method of treating a subterranean formation comprising:

disposing a treatment system in a wellbore, wherein the treatment system comprises a reservoir, formation treatment material in the reservoir, a pressurizing system, a discharge line, a pad, a housing, and a seal;

deploying the pad from the housing and into contact with a wall of the wellbore to seal a region of space between the pad and the wellbore wall from wellbore pressure communication, wherein the region is in communication with the formation;

flowing treatment material from the reservoir to the pressurizing system;

pressurizing the formation treatment material using the pressurizing system to create pressurized formation treatment material; and urging the pressurized formation treatment material to the region and into the formation.

15. The method of claim 14, wherein the formation treatment material is selected from the list consisting of gravel pack repair material, acidizing fluids, brine, alcohol, wellbore stimulation fluids, material for filling voids in casing cement or gravel packs, permeability modifiers, fluids that react with water, oil or, gas, and combinations thereof.

16. The method of claim 14, further comprising pressurizing wellbore fluid.

17. The method of claim 14 further comprising mixing wellbore fluid with the treatment material.

* * * * *